US009427653B1

(12) United States Patent
Chen

(10) Patent No.: US 9,427,653 B1
(45) Date of Patent: Aug. 30, 2016

(54) SKATE BLADE

(71) Applicant: WANN TAY MACHINE FACTORY CO., LTD., Tainan (TW)

(72) Inventor: Yi-Hsuan Chen, Tainan (TW)

(73) Assignee: Wann Tay Machine Factory Co., Ltd., Tainan (TW)

( * ) Notice: Subject to any disclaimer, the term of this patent is extended or adjusted under 35 U.S.C. 154(b) by 0 days.

(21) Appl. No.: 14/950,008

(22) Filed: Nov. 24, 2015

(51) Int. Cl.
*A63C 1/32* (2006.01)

(52) U.S. Cl.
CPC ..... *A63C 1/32* (2013.01)

(58) Field of Classification Search
CPC ..... A63C 1/02; A63C 1/20; A63C 1/30; A63C 1/303; A63C 1/32; A63C 1/34; A63C 1/36; A63C 1/42
USPC ..... 280/11.12, 11.18, 845, 18, 28
See application file for complete search history.

(56) References Cited

U.S. PATENT DOCUMENTS 1,459,050 A * 6/1923 Drevitson ..... A63C 1/38 280/11.12
8,857,823 B2 * 10/2014 Mars ..... A63C 1/303 280/11.15
2008/0100008 A1 * 5/2008 Wan ..... A63C 1/32 280/11.18
2009/0224494 A1 * 9/2009 Wan ..... A63C 1/32 280/11.18
2011/0001297 A1 * 1/2011 Labont ..... A63C 1/32 280/11.12

* cited by examiner

*Primary Examiner* — John Walters
(74) *Attorney, Agent, or Firm* — Alan D. Kamrath; Kamrath IP Lawfirm, P.A.

(57) ABSTRACT

A skate blade contains a base, a reinforcement piece, and a body. The base includes a plurality of first protrusions, and a first recess is defined between any two adjacent first protrusions. The reinforcement plate includes a plurality of second protrusions, and a second recess is defined between any two adjacent second protrusions. Each first protrusion of the base retains with each second recess of the reinforcement plate, and each first recess of the base retains with each second protrusion of the reinforcement plate. The reinforcement plate also includes a plurality of through orifices, and each through orifice is defined on said each second protrusion of the reinforcement plate. The body is injection molded from plastic material and is connected with the base and the reinforcement plate so that a part of the body inserts through the plurality of through orifices of the reinforcement plate.

1 Claim, 3 Drawing Sheets

SKATE BLADE

FIELD OF THE INVENTION

The present invention relates to a skate blade which has anti-collision capacity and is lightweight and reinforced.

BACKGROUND OF THE INVENTION

Ice skates are boots with skate blades attached to the bottom, used to propel the bearer across a sheet of ice while ice skating. However, the skate blades distort and destroy easily as being collided in ice hockey.

The present invention has arisen to mitigate and/or obviate the afore-described disadvantages.

SUMMARY OF THE INVENTION

The primary objective of the present invention is to provide a skate blade which has anti-collision capacity and is lightweight and reinforced.

To obtain above-mentioned objective, a skate blade provided by the present invention contains: a base, a reinforcement piece, and a body.

The base includes a plurality of first protrusions formed on a top thereof, and a first recess is defined between any two adjacent first protrusions.

The reinforcement plate is made of stainless steel and includes a plurality of second protrusions formed on a bottom thereof, and a second recess is defined between any two adjacent second protrusions.

Each first protrusion of the base retains with each second recess of the reinforcement plate, and each first recess of the base retains with each second protrusion of the reinforcement plate.

The reinforcement plate also includes a plurality of through orifices, and each through orifice is defined on said each second protrusion of the reinforcement plate.

The body is injection molded from plastic material and is connected with the base and the reinforcement plate so that a part of the body inserts through the plurality of through orifices of the reinforcement plate.

DETAILED DESCRIPTION OF THE PREFERRED EMBODIMENTS

Figure 1:
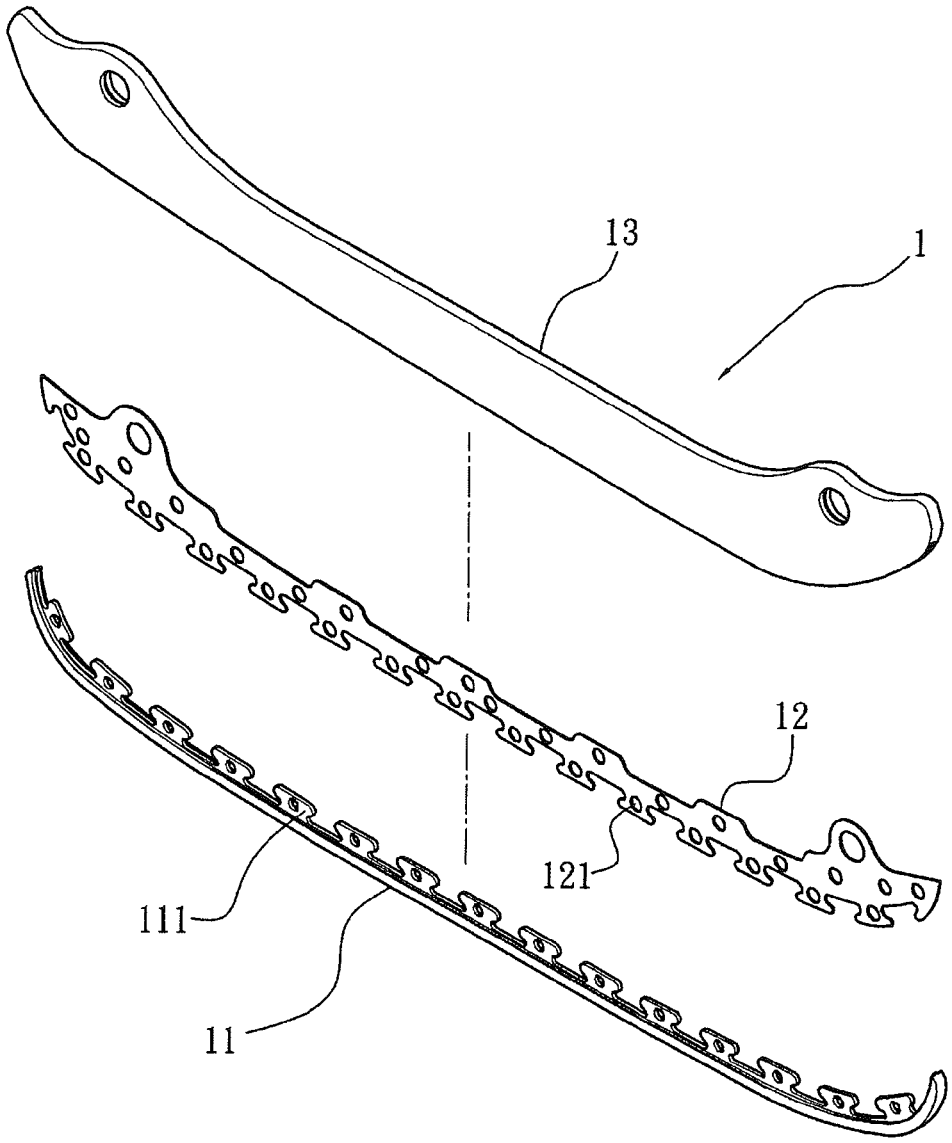
FIG. 1 is a perspective view showing the exploded components of a skate blade according to a preferred embodiment of the present invention.
Figure 2:
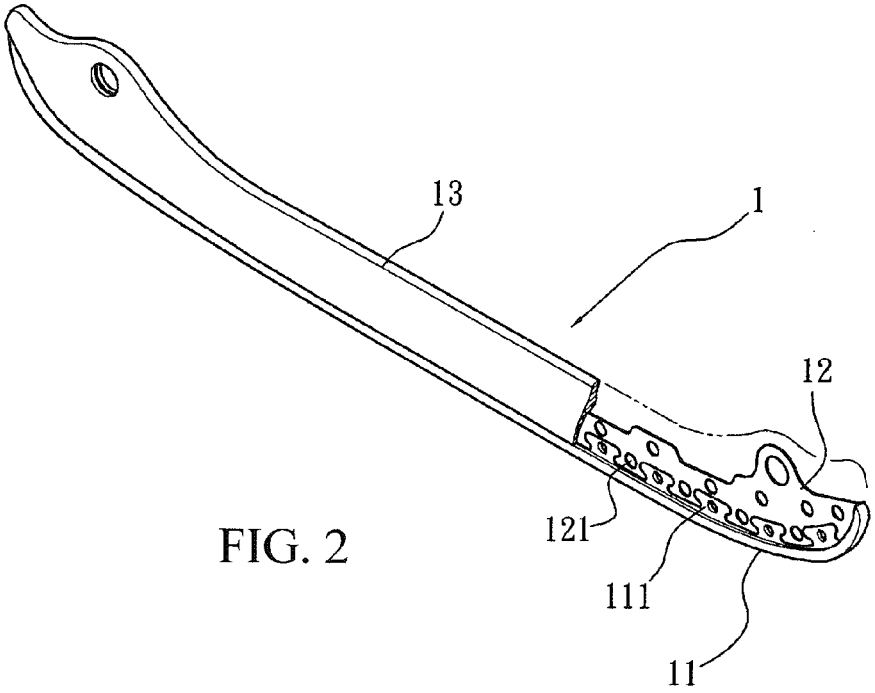
FIG. 2 is a perspective view showing the assembly of the skate blade according to the preferred embodiment of the present invention.
Figure 3:
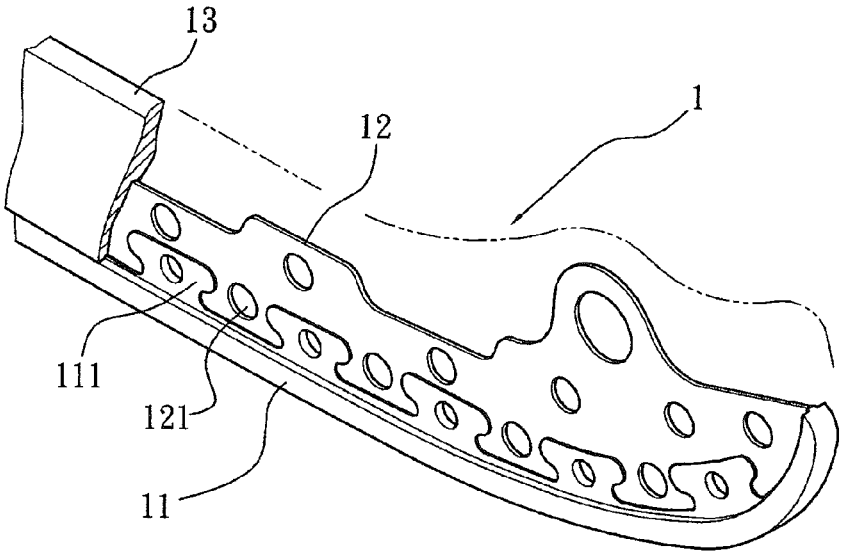
FIG. 3 is a cross-sectional perspective view showing the assembly of a part of the skate blade according to the preferred embodiment of the present invention.
Figure 4:
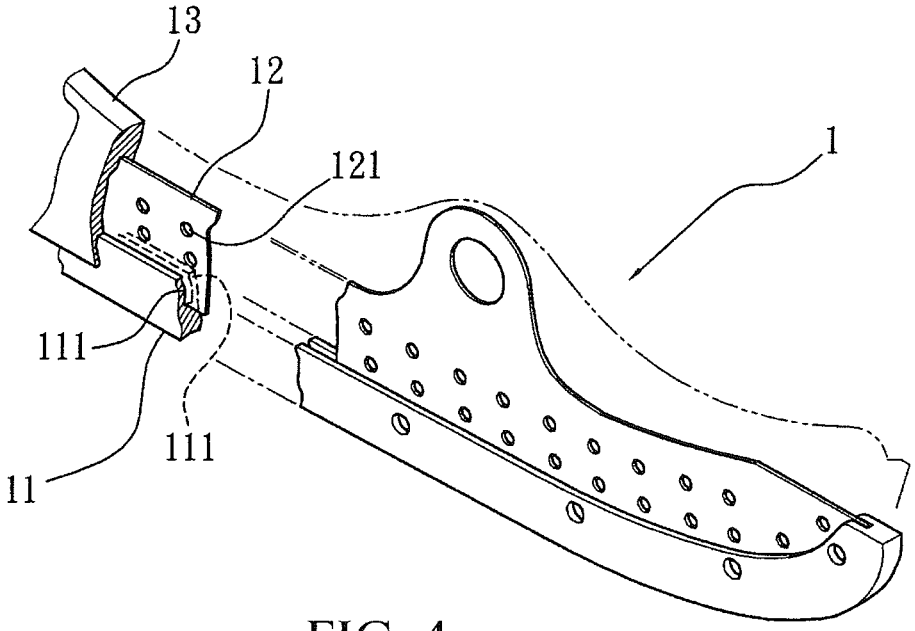
FIG. 4 is a cross-sectional perspective view showing the assembly of a part of a skate blade according to another preferred embodiment of the present invention.
Figure 5:
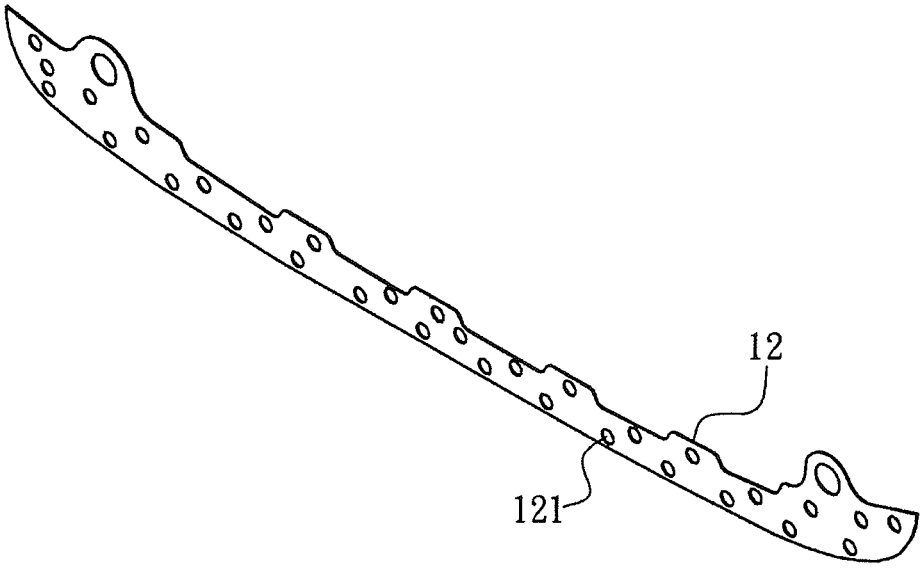
FIG. 5 is a cross-sectional perspective view showing the assembly of a part of a skate blade according to another preferred embodiment of the present invention.

Referring to FIGS. 1 to 5, a skate blade 1 according to a preferred embodiment of the present invention comprises: a base 11, a reinforcement piece 12, and a body 13.

The base 11 includes a plurality of first protrusions 111 formed on a top thereof, and a first recess is defined between any two adjacent first protrusions 11. The reinforcement plate 12 is made of stainless steel and includes a plurality of second protrusions formed on a bottom thereof, and a second recess is defined between any two adjacent second protrusions, wherein each first protrusion 111 of the base 11 retains with each second recess of the reinforcement plate 12, and each first recess of the base 11 retains with each second protrusion of the reinforcement plate 12. The reinforcement plate 12 also includes a plurality of through orifices 121, and each through orifice 121 is defined on said each second protrusion of the reinforcement plate 12. The body 13 is injection molded from plastic material and is connected with the base 11 and the reinforcement plate 12 so that a part of the body 13 inserts through the plurality of through orifices 121 of the reinforcement plate 12. In another embodiment, a carbon fiber cloth layer is covered on the base 11 and the reinforcement plate 12, and a plurality of carbon fiber bars are inserted through the plurality of through orifices 121 and are hot pressed on the body 13, such that the base 11 and the reinforcement plate 12 are connected with the body 13 securely, the skate blade 1 has anti-collision capacity by way of the reinforcement plate 12, and the body 13 is lightweight and reinforced.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. A skate blade comprising: a base, a reinforcement piece, and a body;

with the base including a plurality of first protrusions formed on a top thereof, and a first recess defined between any two adjacent first protrusions;

with the reinforcement plate made of stainless steel and including a plurality of second protrusions formed on a bottom thereof, and a second recess defined between any two adjacent second protrusions;

wherein each first protrusion of the base retains with each second recess of the reinforcement plate, and each first recess of the base retains with each second protrusion of the reinforcement plate;

wherein the reinforcement plate also includes a plurality of through orifices, and each through orifice is defined on said each second protrusion of the reinforcement plate; and wherein the body is injection molded from plastic material and is connected with the base and the reinforcement plate so that a part of the body inserts through the plurality of through orifices of the reinforcement plate.

* * * * *